United States Patent [19]

Caldwell et al.

[11] 4,335,558

[45] Jun. 22, 1982

[54] PREFABRICATED POLYGONAL BUILDING

[75] Inventors: Charles A. Caldwell; William R. Dickson, both of Huntsville, Ala.

[73] Assignee: Domain Building Systems Corporation, Huntsville, Ala.

[21] Appl. No.: 180,232

[22] Filed: Aug. 22, 1980

[51] Int. Cl.[3] ..... E04B 7/00; E04H 1/00

[52] U.S. Cl. ..... 52/13; 52/73; 52/82; 52/94; 52/236.1; 52/732

[58] Field of Search ..... 52/82, 94, 13, 14, 79.4, 52/236.1, 648, 73, 93; 135/3 R, DIG. 1

[56] References Cited

U.S. PATENT DOCUMENTS

| | | | |
|---|---|---|---|
| 3,152,366 | 10/1964 | McCrory | 52/236.1 |
| 3,160,165 | 12/1964 | Geenbie | 52/82 |
| 3,214,872 | 11/1965 | Vogelgesang | 52/82 |
| 3,281,999 | 11/1966 | Keely | 52/82 |
| 3,543,454 | 12/1970 | Danin | 52/79.4 |
| 3,633,325 | 1/1972 | Bartoli | 52/79.4 |
| 3,807,101 | 4/1974 | Cole | 52/82 |
| 3,921,354 | 11/1975 | Connelly | 52/236.1 |
| 4,173,855 | 11/1979 | Raptoplous | 52/236.1 |

FOREIGN PATENT DOCUMENTS

| | | | |
|---|---|---|---|
| 2138907 | 2/1972 | Fed. Rep. of Germany | 52/82 |
| 2511271 | 9/1976 | Fed. Rep. of Germany | 52/79.4 |
| 1389793 | 1/1965 | France | 52/236.1 |

*Primary Examiner*—John E. Murtagh
*Attorney, Agent, or Firm*—Dowell & Dowell

[57] ABSTRACT

A prefabricated building of symmetrical polygonal shape secured onto a concrete slab and symmetrical about a vertical central axis, the building having vertical columns in each polygonal corner and the columns being joined by perimeter beams extending therearound parallel to the slab to form a substantially closed main framework. The building further includes roof beams supported entirely by the columns and extending diagonally upwardly and inwardly to an apex member which joins them. The columns have connectors attached to them to receive the ends of the perimeter and roof beams which comprise two C-shaped members disposed back-to-back with their webs slightly spaced by internally mounted spacers. Prefabricated side and roof panel members enclose the framework, and are made thick enough to hide the beams and the columns and to lap each other to form an inclosed structure. If the building has two stories, it is further provided with another group of connectors fixed partway up the columns to support floor joist beams which are located inside of and comprise part of each prefabricated floor panel.

15 Claims, 16 Drawing Figures

PREFABRICATED POLYGONAL BUILDING

FIELD OF INVENTION

This invention relates to prefabricated buildings and more particularly relates to buildings of the type having a metal frame which supports prefabricated wall, floor and roof panels including metal, wood and plastic portions.

BACKGROUND AND PRIOR ART

The prior art shows many prefabricated buildings of polygonal shape which can be bolted together at the building site. However, many of these buildings are of very marginal construction and are not only substantially without heat insulation, but are also not well-engineered from the point of view of resisting high winds and other forces tending to warp or destroy them.

U.S. Pat. No. 4,173,855 issued to Raptoplous shows a building which is basically similar to the present invention in that it employs columns in the polygonal corners, the columns supporting roof beams which are joined at their centers and are self-supporting thereat. Other buildings of this general type are shown in U.S. Pat. No. 3,152,366 issued to McCrory et al. and 3,281,999 issued to Keely, in French Pat. No. 1,308,023 (1962), and in German Pat. No. 25,09,078 (1976).

There are a number of patents showing buildings made on a hexagonal grid in which portions of the buildings are shared in common, i.e. U.S. Pat. Nos. 3,372,518 issued to Rensch; 3,527,002 issued to Mead and 3,807,101 issued to Cole.

U.S. Pat. No. 4,068,437 issued to Byxbe et al. shows a building using prefabricated panels which are attached together and coupled to beams made up of two C-shaped members, and German Pat. No. 25,11,271 (1978) shows upright metal columns which support sheet metal beams using tongues which extend into the beams and are apparently spot-welded to them, the tongues being supported on vertical circular columns.

THE INVENTION

The invention comprises an improved prefabricated polygonal building module comprising a combination of prefabricated panels and prefabricated building frame members which cooperate with the panels and support them. The frame comprises an upright column in each corner of a polygonal grid on which one or more polygonal building modules are placed, the lower end of the columns being secured by bolted brackets to a foundation supporting the modules and the upper end of each column being provided with a connector member having multiple tongues which extend from each corner in the directions of adjacent corners and also extend inwardly toward the central vertical axis of symmetry of the building module. A closed series of perimeter beams forms each modulator polygon, the ends of the beams being attached to the connector tongues at the tops of the columns. These perimeter beams prevent outward spreading of the tops of the columns away from the module's axis. The roof is entirely supported by roof beams having their outer ends fixed to the same connector members and having their inner ends secured together by an apex member which is centered on the central axis of symmetry of the building, the roof beams extending diagonally upwardly and inwardly so they are self-supporting and require no central column. The apex member, the perimeter beams, the roof beams, and the columns all bolt together so that no welding is required on the site where the building is being assembled. A series of standardized panels, some of which may contain windows or doors, form the side walls of the building and are inserted edge-to-edge in the space bounded by two adjacent columns, by an upper perimeter beam, and by the concrete slab at the lower end. Special brackets in the forms of L-plates and Z-plates are used to hold the wall panels in place, secured by screw fasteners, and the inner and outer skins of the prefabricated wall panels are shaped so that they overlap each other and hide the joints, the columns and the beams against which they are abutted. In the case of a multi-story building, connector members having tongues which are similar to those appearing at the tops of the columns are provided part way up the columns to support prefabricated floor panels at their outer edges, the floor panels being secured together at their edges and ends, and at the central building axis. The floor panels in this configuration are not fully self-supporting, and internal walls or upright supports are provided which cooperate with floor beams, which are built into the floor panels so as to provide them with sufficient rigidity. Most of the major frame components such as the columns, the perimeter beams, the connector bars, and the floor beams are fabricated using standard steel sections, such as pipes, C-sections, and bar stock so that few special configurations need be rolled or extruded in order to fabricate the present building. The roof panels and the side wall panels are prefabricated on frames, studs and beams which are covered with suitable insulating materials and with exposed facing materials to provide satisfactory finishes both internally and externally of the building. The roof panels are provided with metal strips which overlie half the width of each roof beam, and the roof panels also mate with each other about their peripheral edges. The roof panels are then suitably covered with waterproofing sheet material and shingled or otherwise finished to form the outer roof. The concrete slab can be overlaid with suitable coverings to form the interior first floor surface, and the slab and coverings may include insulation against cold and dampness seeping into the building from below.

OBJECTS AND ADVANTAGES OF THE INVENTION

It is a principle object of this invention to provide a prefabricated building module which is supported entirely by a frame which is sufficiently rigid so that a fairly large building can be built in this manner, for instance of the order of 1250 square feet on each floor. Such a building can house schoolrooms, a restaurant, a gasoline station, office space, dwelling units, etc.

Another major object is to provide a building of prefabricated construction which can be very quickly and easily erected and assembled at the site of a suitable foundation requiring only simple tools, and requiring only a few men to assemble the entire building, generally without the use of a crane. One of the most wasteful aspects of constructing an ordinary building which is not of this general type involves work scheduling delays representing time lost while waiting for various different types of workmen to perform their tasks so that the next different task can be performed in the correct sequence. It is a principle object of this invention to permit as much manufacturing as possible to be done at the plant where the prefabricated members are built, thereby leaving relatively less to be done at the site where the building is assembled and roofed. Once the concrete slab has been poured and cured, the remainder of the building can be brought to the site and assembled and roofed, generally in about two days time, and by a factory trained crew of workmen, since the assembly of the building does not require different groups of people such as carpenters, bricklayers, etc. Once the building is assembled, then it is essentially inclosed and ready for the internal finishers, electricians and plumbers to make the final installations in whatever sequence they appear at the job site.

It is another object of this invention to provide a building which is satisfactory in strength from the point of view of resistance to wind and storm damage, etc., and which is cost and energy efficient.

Still another object of the invention is to provide a building module specially designed so that a plurality of similar building modules can be selectively assembled side-by-side to form a composite building cluster, and wherein the various beam and panel structures are formed in such a way that they lend themselves easily to modular clusters which can be increased in size by adding additional modules to a central cluster without the necessity of extensively modifying the existing structure before a new module can be added to it. The hexagonal grid formed of a plurality of identical isosceles triangles is particularly well-adapted to this kind of construction wherein multiple modules are clustered together to form a large composite building. The outer edges of adjacent building modules are actually coincident with each other, and therefore the upright columns at the points of intersections of the grids are common to both building modules meeting at that intersection. Moreover, each perimeter beam which extends between such columns is also common to both modules, the present structure being especially designed to carry out this concept of common frame members where two building modules meet. Along edges of the building where another module is not to be added to it, a roof overhang is added instead. The overhang subassemblies are prefabricated and are continuous along the edge of the roof between two adjacent columns. The roof panels also end at the centers of the perimeter beams, and virtually touch each other where the roofs for two different modules come together.

It is another object of the invention to provide prefabricated side panels for the side walls of the building, which side panels precisely fit together edge-to-edge to fill and enclose the space between the columns, the perimeter beams and the concrete foundation. The panels are designed so that their edges abut and lap each other, and a Visqueen sheet is installed in the field on the inside of the panels after erection to cover their joints, these sheets being in turn covered by the finish wall sheet materials. A series of L-shaped brackets are provided to attach the panels to the perimeter beams, and Z-shaped metal strips are used to fix the panels in position on the concrete foundation to which the building frame is bolted, or on the intermediate level perimeter beams in the case of multi-story buildings. It should be noted that the foundation may comprise a single concrete slab poured especially to support the building frame, or it could comprise individual footings under the verticle columns, or it could comprise part of a larger concrete or paved surface, etc.

Another object of the invention is to provide novel hip joints where the roof panels lap the roof beams, the roof beams having their upper flanges splayed outwardly from each other so as to lie in the planes which are occupied by the roof panels extending from opposite sides of each roof beam.

Still another object of the invention is to provide improved connector means for connecting the various roof and perimeter beams with the upright columns in the corners of the polygonal grid. These connector members comprise a number of horizontally disposed metal bars, each of which is tangent to the supporting column at a point which is midway between two adjacent lines of the polygonal grid. The bars are welded to the columns at these points, and each bar has an end which extends from the weld toward and along one of the polygonal grid lines along which a beam is to be supported. The ends of two adjacent bars are pinched together and oriented so that they form a tongue which lies along one of the polygonal grid lines and is vertically oriented. Each of the perimeter and roof beams comprises two C-shaped members disposed with their webs back-to-back. It is an important improvement of the present invention that the tongues and the webs of the beam are all oriented in vertical planes, which makes the frame of the building much stronger then would be the case if these members were oriented, for instance, in or near a horizontal plane. This fact also makes assembly of the structure much easier because a workmen can merely pass a bolt through a beam and a mating tongue, thereby temporarily securing the members together without having to tighten a bolt in order to provide a self-supporting union of the parts.

It is still a further important object of the invention to provide a building which can be easily erected by a very small number of workmen because of the way in which the parts are designed. The concrete slab has a cluster of upstanding bolts imbedded therein during pouring in the vicinity of the corner intersections of the hexagonal grid, and each column which mounts in one of those corners has a bolting plate at its lower end which mates with a cluster of bolts and serves to support the column in upright position so that a workmen can easily erect the columns and have them remain substantially vertical while he mounts a series of perimeter beams thereon to form a stable basic frame structure. Once the perimeter beams are added and the bolts at the bases of the columns are snugged, a light scaffolding is erected around the central axis of symmetry of the building module, the scaffolding temporarily supporting an apex member while the workmen install roof beams between the tongues on the apex member and opposing tongues on the connector members located at the tops of the columns. When these beams have all been installed, the bolts in the structure can be tightened securely, and the wall panels and roof panels can then be installed in place by the workmen, whereby a completely inclosed building has been erected generally in about two or three days using five or six workmen.

Other objects and advantages of this invention will become apparent during the following discussion of the drawings which illustrated one practical embodiment.

THE DRAWINGS

Figure 1:
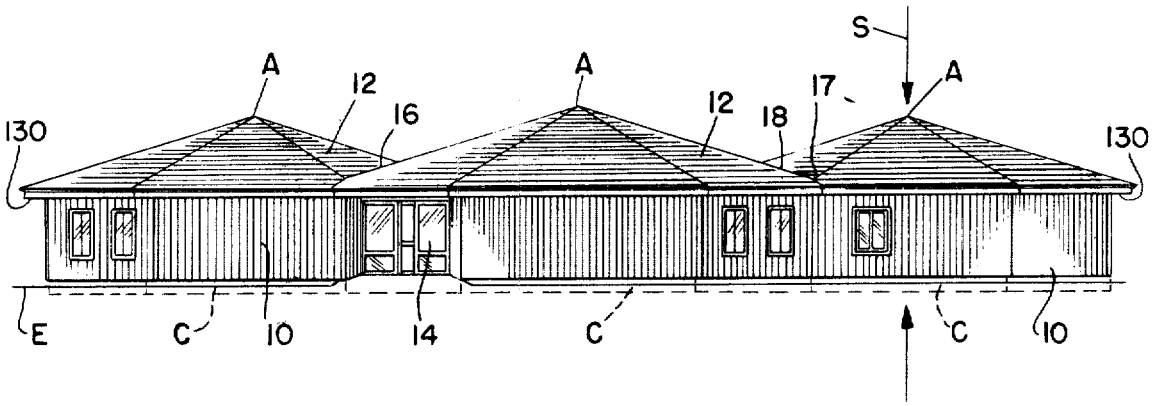
FIG. 1 is an elevation view of a cluster of modular buildings made according to the present invention.
Figure 2:
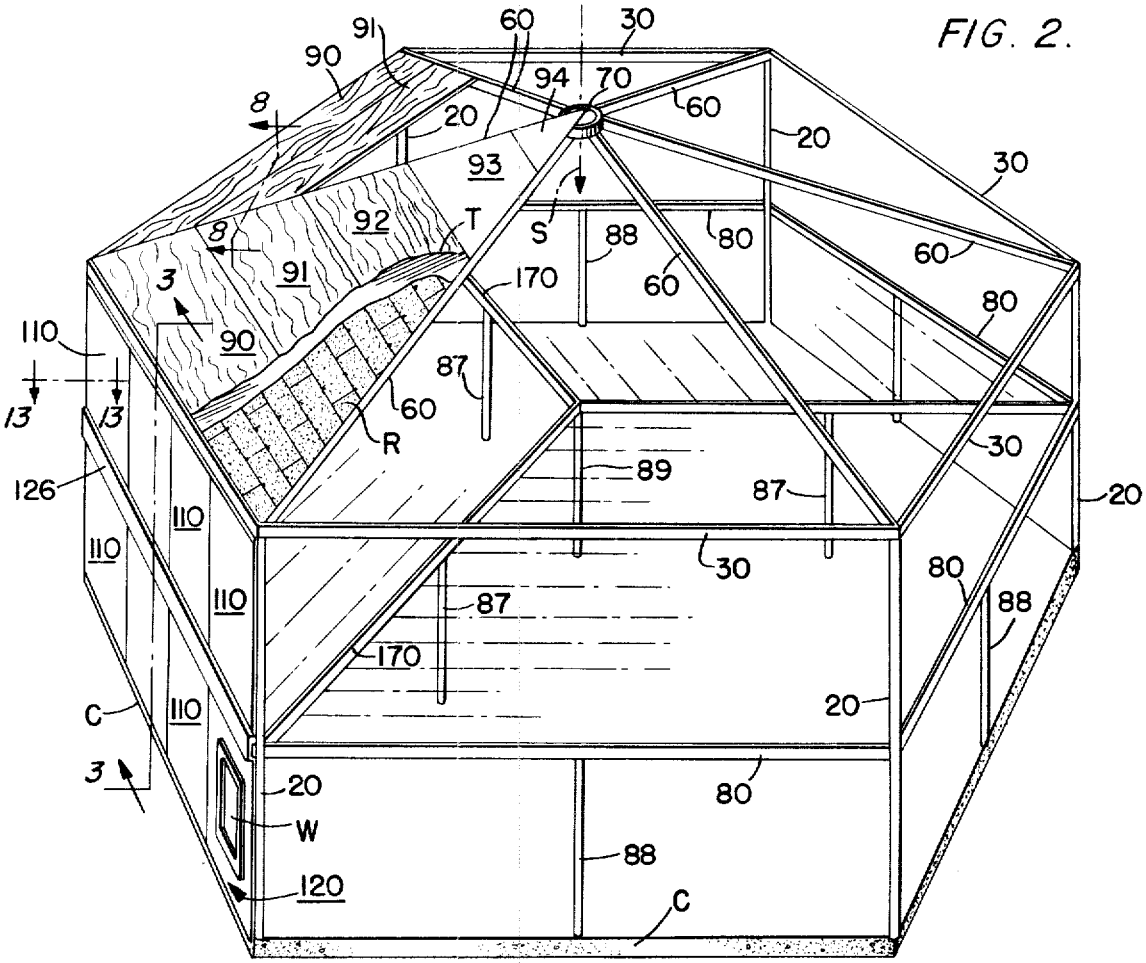
FIG. 2 is an enlarged view showing the frame of one building made according to the present invention, the illustrated building having two stories.
Figure 8:
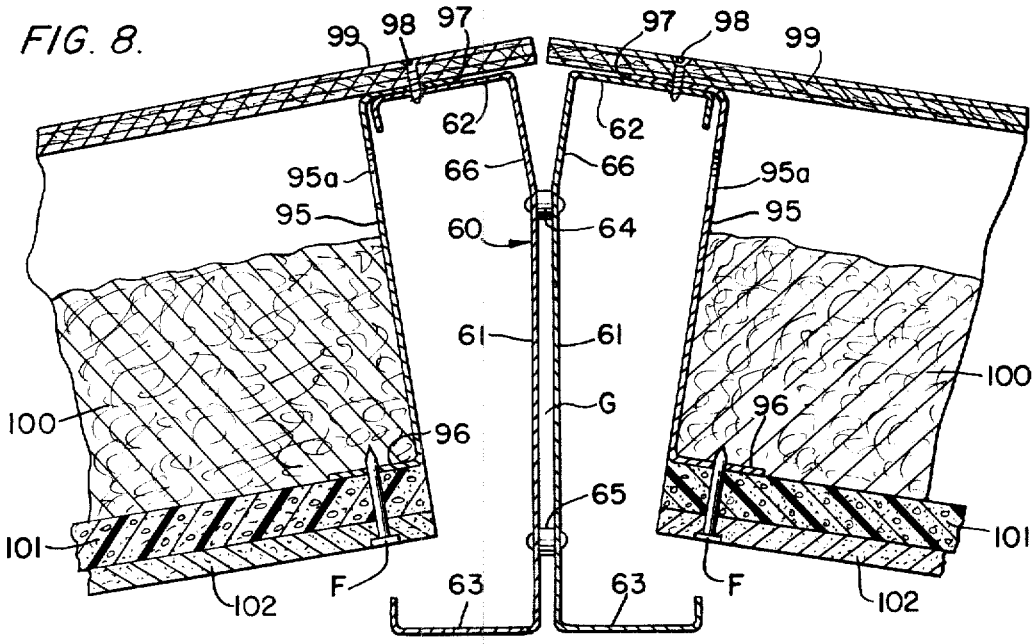
FIG. 8 is an enlarged sectional view taken along lines 8—8 of FIG. 2.
Figures 3, 6:
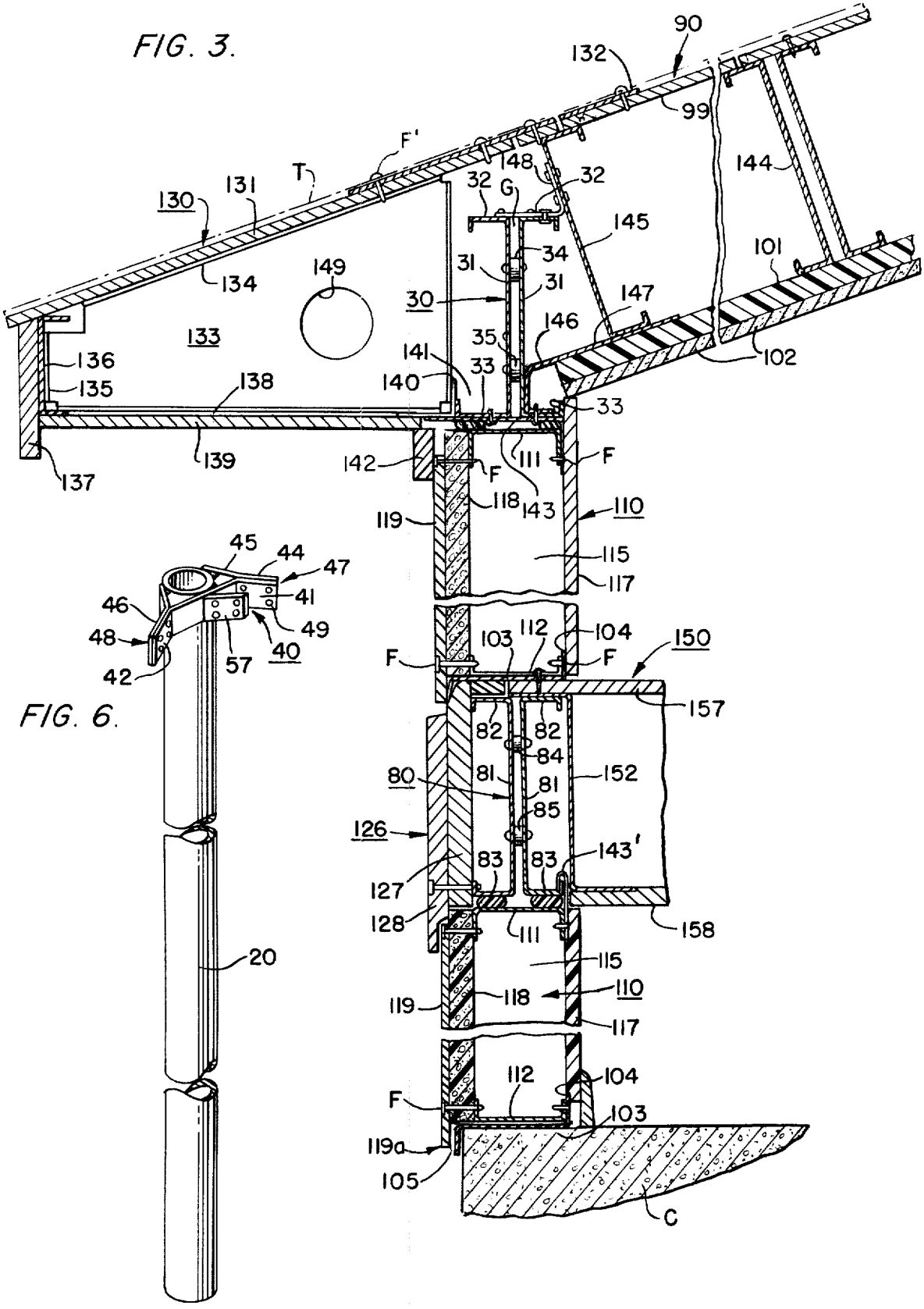
FIG. 3 is an enlarged cross-sectional view taken through the sidewall and roof along line 3—3 of FIG. 2 but adding a roof overhang assembly to the cross-section.
FIG. 6 is a prospective view of a column having a somewhat modified connector means located at the top of it.
Figure 11:
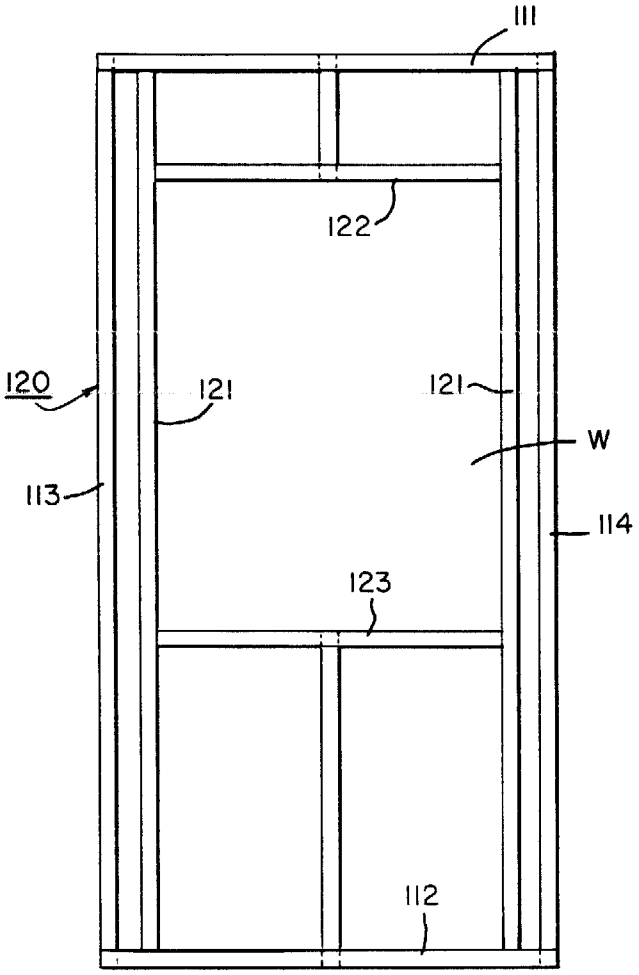
FIG. 11 is an elevation view similar to FIG. 10 but showing a panel modified to provide a window opening.
Figure 10:
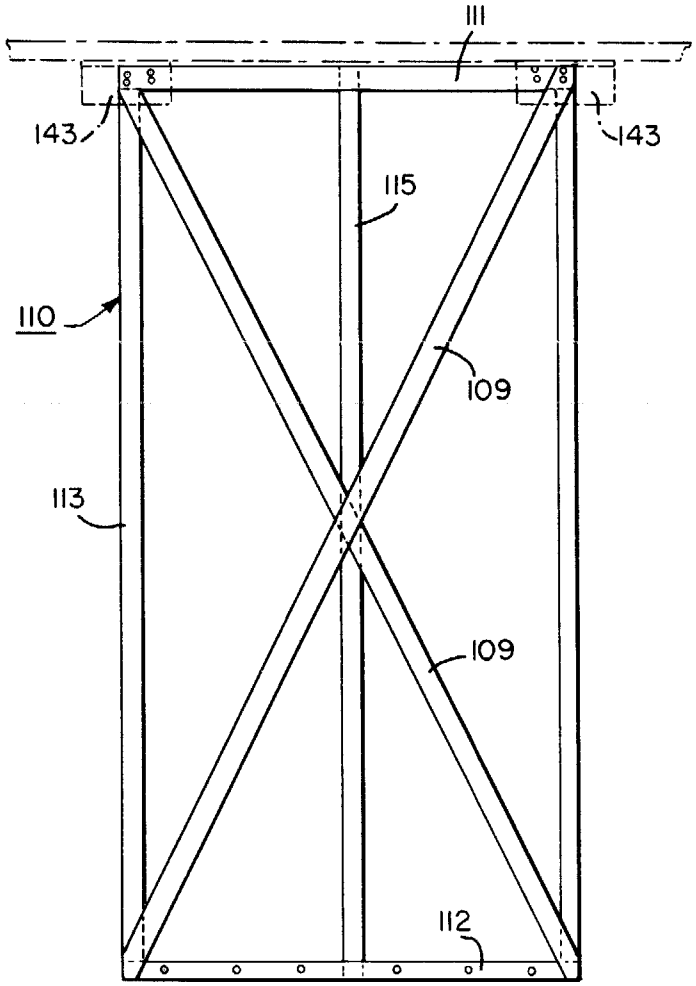
FIG. 10 is an elevation view of the framing of a typical wall panel having no openings therein, shown with the exterior panel sheet removed.

Referring now to the various figures of the drawing, which show a practical embodiment of the invention, FIG. 1 shows a cluster of multiple polygonal building modules supported on the ground G on concrete slabs C. The buildings comprise sidewalls 10, formed of individual wall panels 110 and 120 as shown in FIGS. 2, 10 and 11, and a roof 12 also comprising multiple individual panels 90, 91, 92, 93 and 94 as shown in FIGS. 2 and 8. The wall panels 10 may comprise either blank panels as shown at 110 in FIG. 10, panels with windows as shown at 120 in FIG. 11, or panels comprising doorways as shows at 14 in FIG. 1. It will be noted that the illustrated buildings are modular and comprise modules laid out on a hexagonal grid of 60° triangles, and that these modules can be joined together at the intersections of their roofs as shown for instance along the lines 16 and 18 in FIG. 1, and also in FIG. 12. Each of the roofs has an apex A which lies upon a vertical axis of symmetry S extending through the apex and to the earth E, as shown to the right in FIG. 1. Each building module can be either one story, as shown in FIG. 1, or two or more stories as shown in FIGS. 2 and 3, depending on requirements at a particular location. The building is supported entirely on metal framework which is prefabricated and bolted together in a manner which will be presently explained in greater detail.

Figure 4:
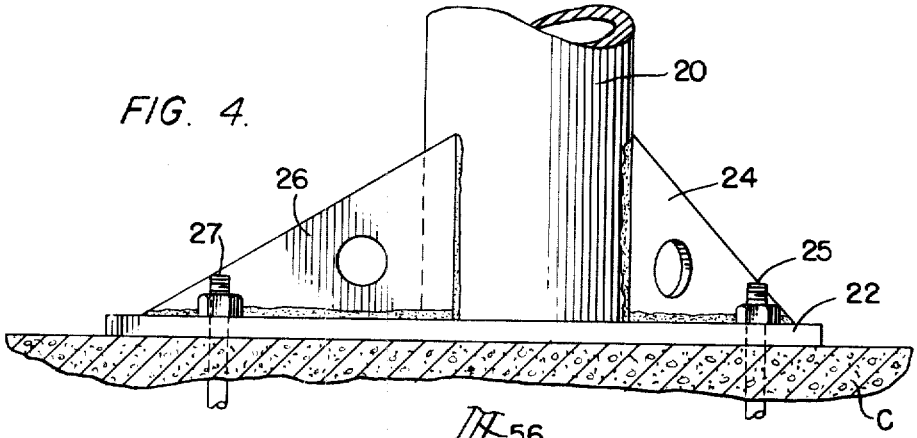
FIG. 4 is an elevation view of a bracket which supports the lower end of a corner column of the building by bolting to the concrete floor slab.
Figure 13:
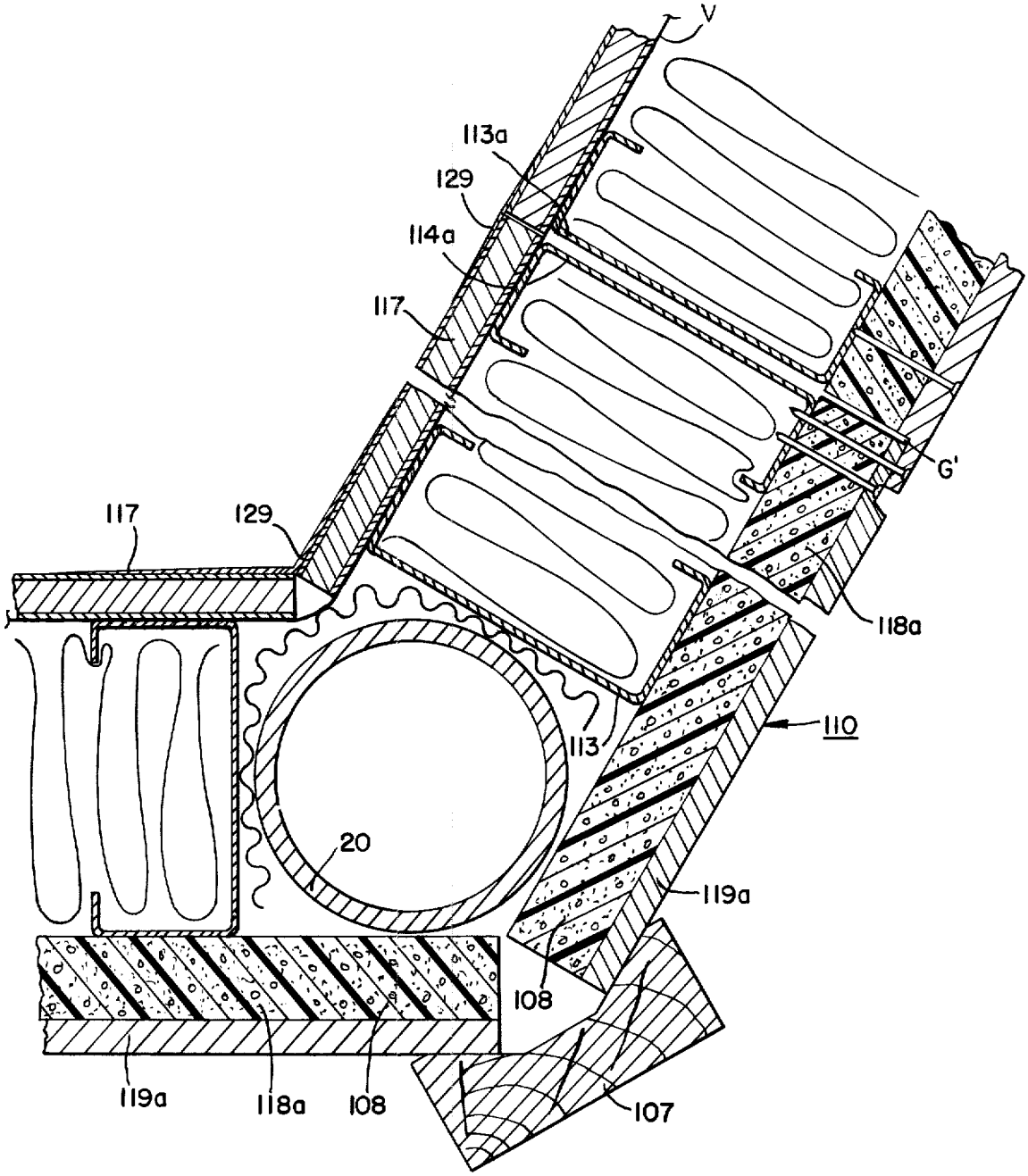
FIG. 13 is a sectional view taken along line 13—13 of FIG. 2.

FIG. 2 shows the metal framework for a building having two stories. The building rests upon a concrete slab C and comprises, for a hexagonal building, six upright columns 20 which are cylindrical as shown in FIGS. 6 and 13. These columns are each terminated at the lower end in a bracket, FIG. 4, including a right angle plate 22 with strengthening gussets 24 and 26 welded thereto. The concrete slab C has a cluster of bolts 25 and 27 extending upwardly therefrom, the bolts being located in the vicinity of each corner intersection of the hexagonal building grid whereat an upright column is centered. The bolts 25 and 27 are symmetrically located with respect to the axis of the cylindrical column 20, and in the case of a larger building four, or so, bolts will be clustered about each corner and heavier brackets will also be used at the feet of the columns where they bolt to the concrete slab. It will be seen that as a result of the plate 22 being bolted to the concrete slab C, each of the six corner columns 20 is immediately self-supporting on the slab. These columns are therefore erected first when the building is being assembled so that they stand substantially upright.

Figure 5:
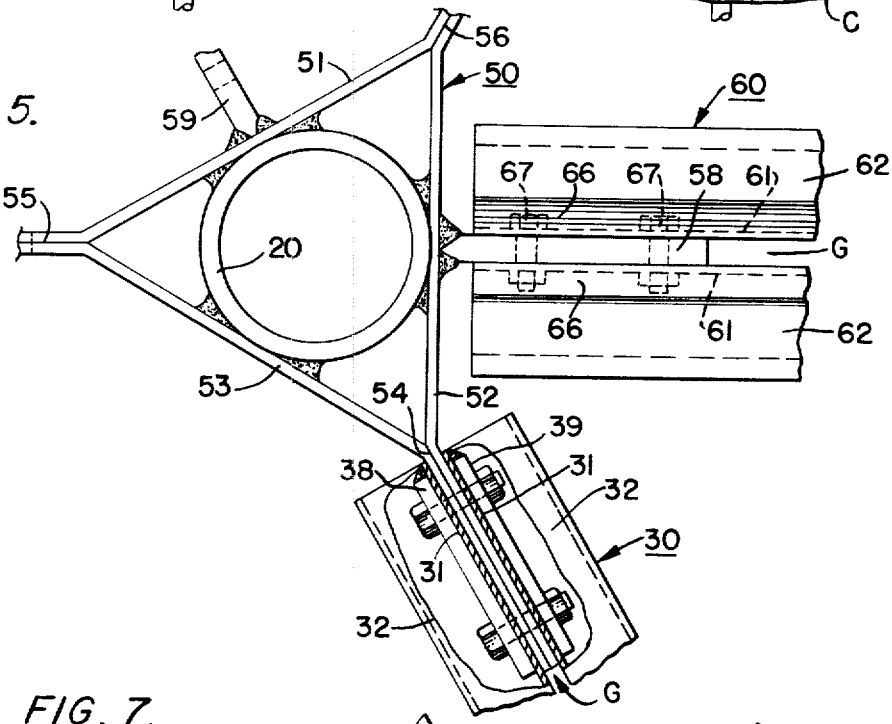
FIG. 5 is a plan view of a beam connector means located at the top of a column and serving to receive and coupled together perimeter beams and roof beams, or floor beams, of a building.

Each of the columns 20 supports the ends of two adjacent perimeter beams 30 which extend all the way around the building and join the tops of the columns 20 together. As can be seen near the top of FIG. 3, each of the perimeter beams 30 comprises two C-shaped channels, each having a central web 31 located between opposite flanges 32 and 33. The channels are placed with their webs back-to-back and are spaced apart through a small distance by suitable spacers 34 and 35. Each perimeter beam therefore comprises two back-to-back C-channels and multiple spacers which connect them together as shown at the top of FIG. 3. The top of each of the building's corner columns 20 as can be seen in FIG. 6 includes a connector member 40 comprising multiple steel bar members which are welded tangentially to the column 20 and which have their ends pinched together so that each pair forms a tongue. For instance, the metal bar 43 has two ends 41 and 42, the end 41 cooperating with the end 44 of an adjacent metal bar 45 to form a tongue 47, and the end 42 cooperating with the end 46 of another adjacent bar to form a tongue 48. The vertical heights of the tongues 47 and 48 are a little less than the vertical heights of the webs 31 of the adjacent beams, and these webs are drilled horizontally with holes which line up with the holes 49 as shown for instance in the tongues 47 and 48. Therefore, two perimeter beams 30 are mounted to the tops of the columns 20 by passing the lugs 47 and 48 between their webs 31 and then bolting the webs and the tongues together to form a strong and substantially rigid connection as can be seen in FIG. 5. The connector member 40 located at the top of the column 20 shown in FIG. 6 is the type used for a single module building which does not have other hexagonal building modules extending away from it.

If a multiple module structure as shown in FIG. 1 is to be used, wherever the hexagonal grids of the buildings intersect at a column, that column is provided with a connector member as shown in plan view at 50 in FIG. 5. In this figure, the connector has one more tongue than is shown in FIG. 6, this third tongue comprising two ends which would be extensions of the bar members supporting the ends 44 and 46 in FIG. 6. Thus, there are 3 metal bar members in the connector 50 shown in FIG. 5, the bar members comprising the bars 51, 52 and 53 whose centers are all welded tangent to the column 20 and which all have ends extending outwardly and mated with the ends of adjacent bar members to form tongues 54, 55 and 56, the tongues 55 and 56 being only partially shown. The tongue 54 is shown connected to the end of a perimeter beam 30 whose upper flanges 32 are broken away so as to show the web 31 attached to the tongue 54. The gap G between the two C-channels forming the beam 30 is occupied by the tongue 54, and in addition two reinforcing plates 38 and 39 have been welded to the webs 31 of the beam 30, suitable bolts passing through a pattern of holes in the reinforcing plates 38 and 39 and the webs 31 in order to secure the perimeter beam 30 in place on the tongue 54. The perimeter beams which join the tongues 55 and 56 are similarly structured and connected.

It will be noted that each of the connectors 40 in FIG. 6, or 50 in FIG. 5, has one or more tongues which extend at right angles from the center of one or more of the metal bars, and these tongues are used to support roof beams 60, or to support floor beams 80 in a manner to be presently described.

Figure 7:
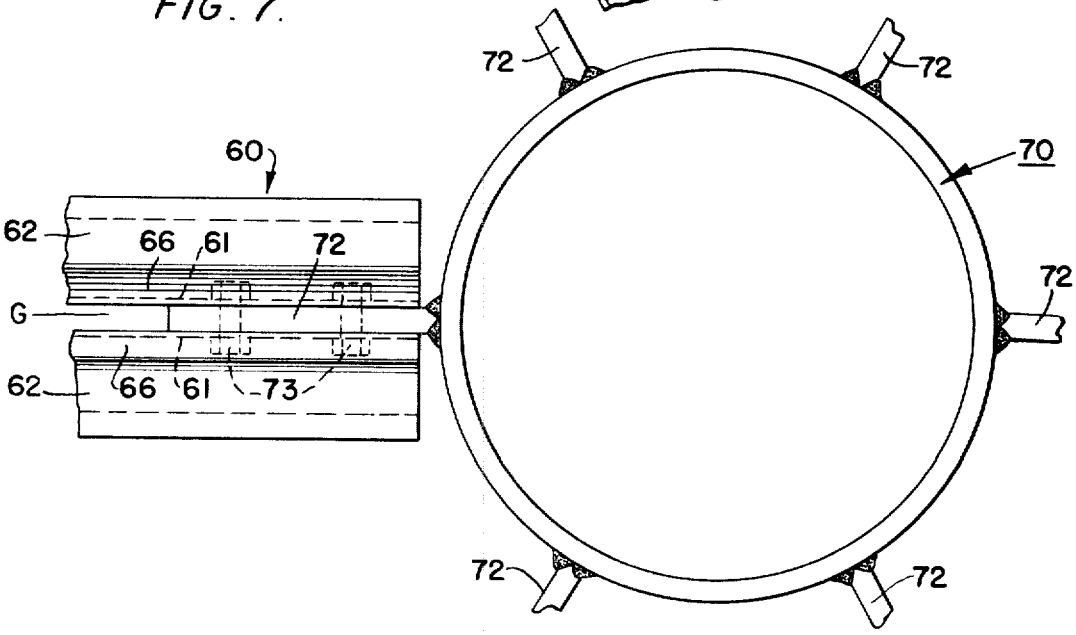
FIG. 7 is a plan view of an apex member which receives and secures the roof beams in the axial center of the building.

Returning to FIG. 2, the roof structure is supported by roof beams 60, these beams being supported at their outer ends at the various columns 20, and being supported at their inner ends by an apex member 70 which is centered about the axis of symmetry S of the building and is shown in FIG. 7. The cross-sectional shape of the roof beams 60 can best be seen in FIG. 8. These roof beams 60 are similar in structure to the perimeter beams 30 and 80 except for a few differences. Each of the roof beams comprises two back-to-back C-channel members, each having a web 61, upper flanges 62 and lower flanges 63, the beams being held somewhat apart by spacers 64 and 65. The two C-channel members are splayed apart as at 66 at their upper ends above the spacer 64 so that the upper surfaces of the flanges 62 lie in planes making an obtuse angle to each other, these planes being the same planes as are occupied by adjacent roof panels 91 located on opposite sides of the same roof beam 60. The gap G between the webs 61 in the roof beam 60 is the same as the gap G between the webs in the perimeter beams 30 and 80.

As can be seen in FIGS. 5 and 6, additional tongues are supported intermediately between the tongues which support the perimeter beams 30, these tongues being labelled 57 in FIG. 6 and 58 and 59 in FIG. 5. Of these tongues, only the one labelled 58 is shown connected to one of the roof beams 60. The tongue 58 is welded to the metal strap member 52 and extends outwardly into the gap G between the two web portions 61 of the roof beam. The tongue is bolted to the webs 61 by bolts 67. The webs 61 in the vicinity of the bolts 67 can be further reinforced by plates (not shown) corresponding in appearance and function with the plates 38 and 39 shown inside the perimeter beam 30 of FIG. 5. The tongue 58 occupys the gap G in the web space beneath the splayed portions 66 of the roof beam. Note that there is another tongue 59 extending upwardly and leftwardly from the metal strap 51 in FIG. 5. If the column 20 which supports these tongues is located at the point 17 in FIG. 1, for example, then the column 20 of FIG. 5 will support two roof beams, one coming from the central building in FIG. 1 and the other coming from the righthand building in FIG. 1. The structure of the roof beam from the central building and the manner in which it engages the lug 59 will be the same as is shown at the lug 58 in FIG. 5, and the structure is therefore not repeated.

The apex member 70 which supports the inner ends of all of the roof beams is shown in FIG. 7, only one of the roof beams 60 being shown attached thereto. This apex member is also visible at the top of FIG. 2. The apex member 70 comprises an annular continuous ring 71 having 6 tongues, each labeled 72 and extending outwardly and downwardly therefrom, all of the tongues 72 being similar to the leftmost tongue. Each of the tongues 72 receives a roof beam 60, which is identical to the beam shown to the left in FIG. 7, and the tongue extends between the web portions 61 beneath the level of the splayed portions 66 as can be seen in FIG. 8. Bolts 73 pass through the web portions 61 and the tongue 72. Ordinarily there are 4 such bolts arranged in a pattern similar to the hole pattern shown on the upwardly extending lug 57 in FIG. 6. Initially during assembly of the building, the apex member 70 is temporarily supported by portable scaffolding centered above the axis of symmetry S of the framework, but once the roof beams 60 are all secured in place, the roof structure then becomes self-supporting and the scaffolding is removed.

If the building is to be a two story structure, then, as shown in FIGS. 2 and 3, a second group of perimeter beams 80 are required, and these beams extend around the building below the perimeter beams 30, supported midway up the columns. Obviously, more than two stories can be built in this manner. For each annular series of perimeter beams 80 which are required to support a floor for an intermediate story, a connecting means of the type shown at the top of FIG. 6 is employed, mounted partway up each column 20. The perimeter beams 80 are constructed just like the perimeter beams 30 and are secured to tongues 47 and 48 which are 120 degrees apart about the column. However, the floor beams 82 are attached to horizontal tongues corresponding with the tongue 57 in FIG. 6 located midway between the perimeter beam tongues, as will be further discussed hereinafter.

Figure 9:
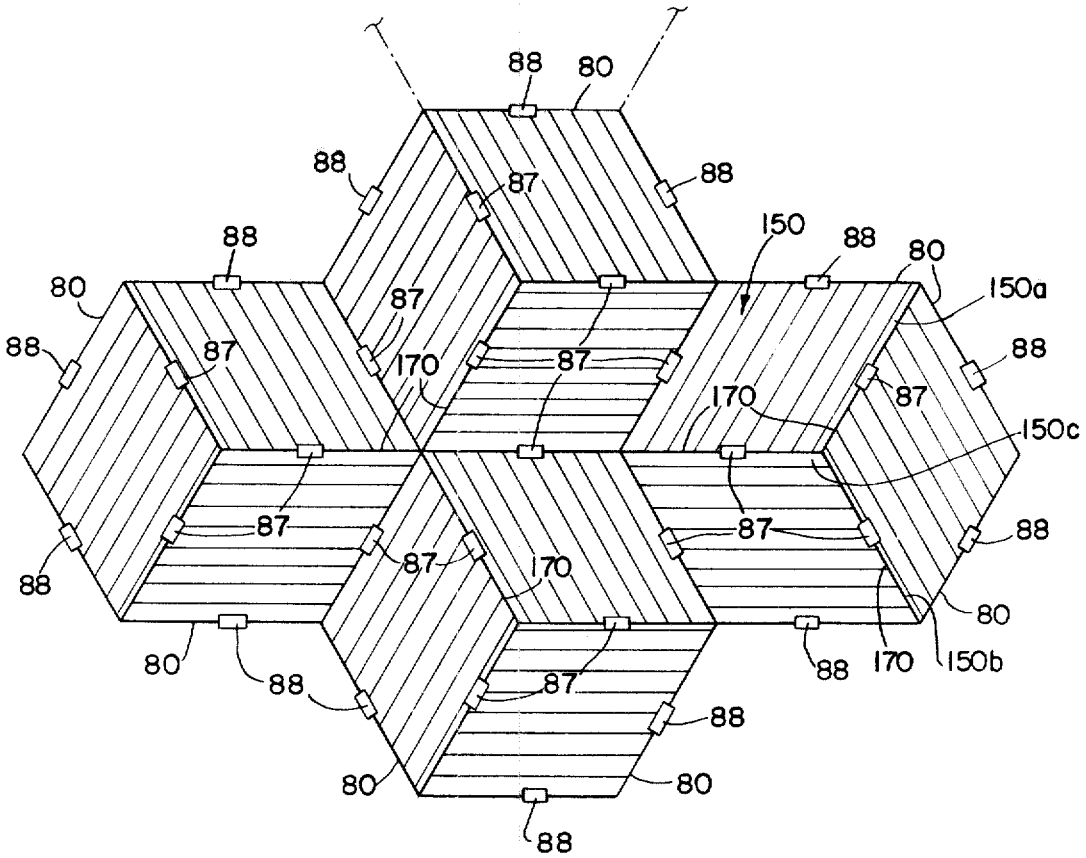
FIG. 9 is a floorplan showing a preferred floor panel arrangement for a cluster of buildings as shown in FIG. 1.

The inner ends of the floor beams 170 are secured together in the center of the building by a connector member similar to the one shown in FIG. 5 but lacking the tongues 58 and 59. A column 89, FIG. 2, carries the connector and helps to support the floor against the concrete slab C. It will be noted that the floor beams 170 are not fully self-supporting, and that in order to withstand the heavy floor loading thereon it may be necessary to place some vertical supports at spaced intervals along them. These need not be vertical beams, but can in fact comprise walls or portions of walls supported on the ground floor. FIG. 9 shows a preferred layout of the floor plan, and the small rectangles labelled 87 are intended to indicate structural support members which may be either columns or interior walls. In addition, in some installations it may be desirable to support the perimeter floor beams 80 at their midpoints 88 in order to avoid any possibility of vibration or collapse from high loading of the floors.

Referring again to FIG. 2, on the left rear side of the structure there are illustrated two roof panels 90 and 91 toward the rear of the building mating with adjacent roof panels 90 and 91 toward the front on the opposite side of a roof beam 60, the space between roof beams, forward of the leftmost roof beam 60 also including panels 92, 93, and 94. The uppermost roof panels 94 are triangular and include portions which overlie and close the apex member 70, meeting at the axis S of the building. FIG. 8 is a cross-sectional view taken through the intersections of adjacent panels 91 and including the roof beam 60 which supports them. Each of the roof panels is trapezoidal and includes an upper surface such as the plywood surface 99, a thickness of fiberglass insulation 100, a layer of rigid insulation 101, and an interior ceiling tile 102. Air holes 95*a* above the insulation 100 are provided to dissipate moisture produced by condensation. These laminae are held together periodically by members such as the Z-section strips 95 which are bonded, nailed or screwed by fasteners F to the panels at flanges 96. The strips 95 each has a flange 97 which lies between the plywood sheet 91 and the flange 62 of the adjacent roof beam. Since the adjacent roof panels on opposite sides of the beam 60 through which the cross-section of FIG. 8 is taken do not lie in the same plane, the web portions of the roof beam have been splayed outwardly at 66 so that the flanges 62 thereof lie in the proper planes to receive the roof panels 99. These panels can be screwed by sheet metal screws 98 to the associated flanges 62 of the roof beams. The roof is then finished in any usual manner, for instance by placing tar paper T and roofing shingles R thereover. When the shingling is completed, the center of the apex member 70 is closed thereby.

In FIG. 3, the structure of the lowermost roof panel 90 can be seen. It includes a C-shaped frame member 144 along one edge and a similar C-shaped frame member 145 along the other edge. The frame member 145 rests upon a clip 146 at its lower leg 147, the clip comprising a bracket which attaches to the lower flange 33 of the perimeter beam 30. Similarly, there is a second bracket 148 which is attached to the upper flanges 32 of the perimeter beam 30 to fix the roof panel to the perimeter beam where the panel and beam approach eachother. A hole 149 is provided in each partition for electrical wiring to outdoor lighting fixtures (not shown).

FIG. 2 also shows on the left side of the building eight wall panels in place beneath the panelled portion of the roof. These wall panels are supported as shown in FIG. 3 which is a sectional view taken along line 3—3 in FIG. 2. The panels are also constructed as shown in greater detail in FIGS. 10, 11 and 13. Two different types of side panels are shown in the lefthand wall of the building of FIG. 2. These include panels such as the panels 110 which are of the type shown in FIG. 10 and have no openings therein, and a panel 120 which is of the type shown in FIG. 11 with a window opening W therein. Note that the second floor panels and the first floor panels are identical in external shape so that the only difference in the various wall panels depends on whether they have no opening, a window opening, or a door opening. FIG. 1 shows various door and window openings, and of course the possibilities for the numbers and types of openings are virtually limitless and form no part of the present invention.

Referring now to the more detailed showings of FIGS. 3, 10, 11 and 13, the panels 110 comprise upper metal frames 111, lower metal frames 112, and side frames 113 and 114. In addition, the panel 110 includes an upright stud 115, the stud 115 perhaps being a wooden two-by-four, or the equivalent metal cross-section. When metal frame members are used, they can be welded or screwed together. Each of the panels 110 also includes an interior trim facing 117 which will be installed in the field after the panel is in place. The panel further includes an insulating barrier 118 and an outer facing sheet 119 of suitable type to give the building a finished appearance on the outside. The space between the studs and the frame members should of course be filled with suitable batts of insulating material (not shown in most views), such as rock wool, etc. In addition, X-members 109 have been found desirable to stiffen the panels against parallelogram deformation, thereby increasing the wind strength of the building.

The panel 120 as shown in FIG. 11 includes similar upper and lower and side frame members 111, 112, 113 and 114, but two upright studs 121 are located far enough apart so as to provide a window aperture W. This aperture includes upper and lower sill members 122 and 123. A suitable window unit assembly can be used in the opening W, or alternatively the sill 123 can be removed and an opening door assembly placed in the panel 120.

FIG. 13 shows a typical corner column 20 which is overlapped by two wall panels and hidden thereby. These corner wall panels are similar to panels 110 and 120 shown in FIG. 10 and 11 except that they have elongated exterior insulation and facing sheets 118*a* and 119*a* which are extended in the vicinity of the reference characters 108 in FIG. 13 to cover and hide the column 20. A finish strip 107 covers the joint outside, while suitable tapes 129 cover the panel joints in the interior of the building. Note near the upper righthand corner of FIG. 13 where the frame members 114*a* and 113*a* come together, that the intersection gap G' where the exterior panels meet lies symmetrically between these frame members. Beneath all of the interior wallboards 117, a vapor barrier sheet V, made of a suitable material such as Visqueen, is installed after the wall panels are in place and prior to installation of the finish wallboards 117.

As can be seen in FIGS. 1 and 3, the buildings are provided with an overhang member 130 which extends all the way around the building, except that it is omitted in the locations where two buildings form adjacent modular interconnections. In such a case, diverging perimeter beams 30 of the buildings which are mutually adjacent are supported on separate tongues 54, 55 and 56 as shown in FIG. 5. The wall panels can be omitted under any perimeter beam which is shared by two adjacent buildings to provide enlarged unbroken floor space. The joining of the roof portions of adjacent modular buildings will be described in greater detail hereinafter with reference to FIG. 12.

However, where the roof panel 90, FIG. 2, does not join an adjacent building module a separately fabricated overhang member 130 is attached to the building as shown in FIG. 3. The overhang member includes a plywood sheet 131 which aligns with the roof panel 90 and is screwed to its sheet 99 using an elongated metal plate 132 and fasteners F', which are then concealed under roofer's tar paper T. The overhang member 130 has longitudinally spaced sheet metal partitions 133 with upper flanges 134 attached to the plywood sheet 131, front flanges 135 attached to a bracket 136 which supports a facing strip 137, and bottom flanges 138 which are attached to a bottom sheet 139. The bottom of the overhang member 130 is provided at its lower inner edge with an L-member 140 secured to the partition 133 and to the L-bracket 143, and this bracket 143 is then secured to the lower flanges 33 of the perimeter beam 30 by fasteners F. A trim strip 142 conceals the joint between the finish sheet 119 and bottom sheet 139.

Figure 14:
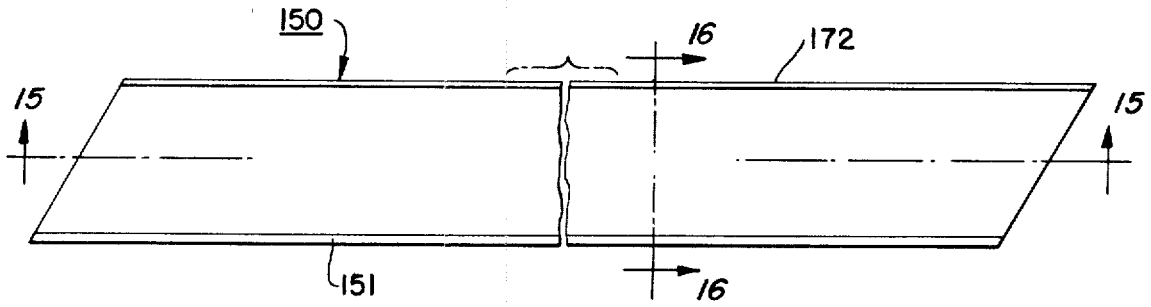
FIG. 14 is a plan view of a typical floor panel.

In the case of a two story building, which may also be built with three or more stories if desired, the floor panels as shown in FIG. 9 are supported on the floor perimeter beams 80 and on the columns 20 of FIG. 2. Such a floor perimeter beam 80 is shown in FIG. 3 and comprises two web portions 81, upper and lower flanges 82 and 83, and spacers 84 and 85. These beams are substantially indistinguishable from the beams 30 except by location. The perimeter beams 80 are supported on connector means carried half-way up the column, 20, the connector means (not shown) being similar to those shown in FIG. 6. Adjacent perimeter beams are supported by bolting to the tongues 47 and 48, and tongues 57 support floor beams 170 which are located within floor panels 150 as shown to the left in FIG. 16. The floor panels are generally referred to by the reference character 150, and their construction is described with reference to FIGS. 14, 15 and 16.

Figure 15:
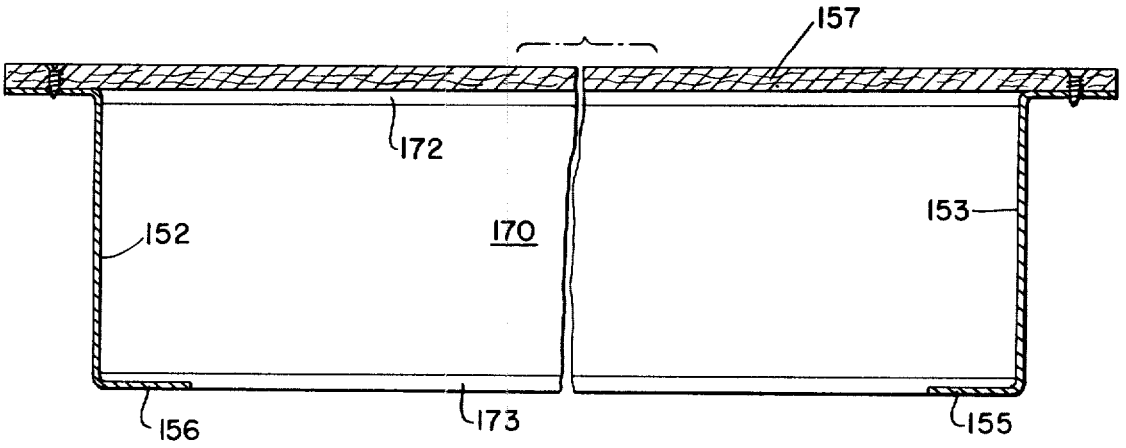
FIG. 15 is an enlarged sectional view taken along line 15—15 of FIG. 14.
Figure 16:
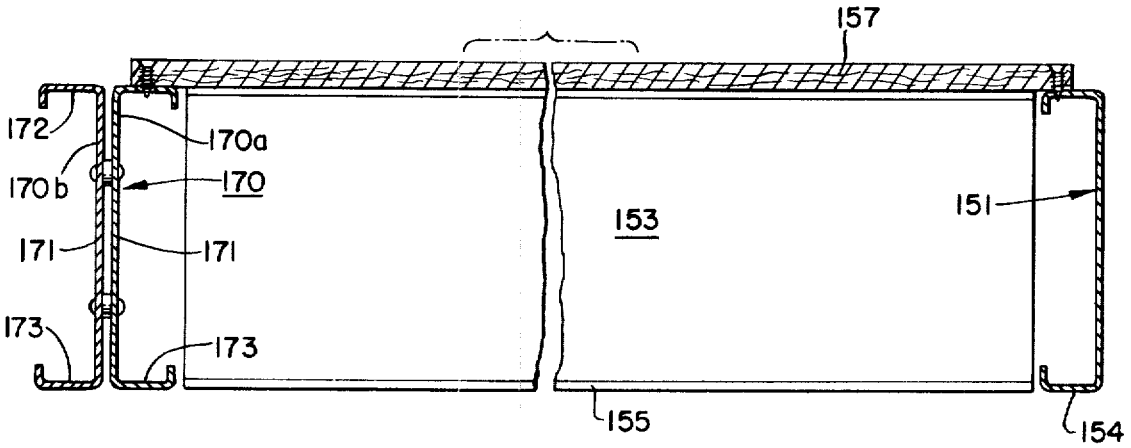
FIG. 16 is an enlarged sectional view taken along line 16—16 of FIG. 14.

The floor panels 150 are virtually alike except that three of them will contain a load bearing floor beam 170. For instance, in FIG. 9 the panels labeled 150*a*, 150*b* and 150*c* will respectively contain the floor beams 170, mounted as shown to the left in FIG. 16. All the other panels 150 will contain only the right hand C-frame member 170*a* while omitting the other C-frame member 170*b*. All of the floor panels 150 will include the C-frame member 151 in FIG. 16 and the two Z-frame members 152 and 153 as shown in FIG. 15. A wood floor panel 157 is supported on each of these frame members which form a box frame, and suitable ceiling tile 158 for the first floor can be mounted to the lower flanges 173, 154, 155 and 156 as shown in FIG. 3.

It is to be noted in FIGS. 2 and 3 that the outer face of the perimeter beam 80 at the second floor level would be exposed unless specially covered because the exterior facing sheets 119 of the upper and lower wall panels 110 do not cover the beam 80. Therefore, a special strip 126 is applied to the outside of the beam and extends horizontally to cover the full length of the beam as can be seen best on the lefthand side of FIG. 2. The strip 126 as shown in FIG. 3 may advantageously include an insulation member 127 and an outside facing strip 128 which preferably laps the lower panel. Note that the facing sheet 119 of each of the wall panels 110 laps downwardly over whatever is below it. The facing of the lower most panel 110, at 119*a* near the bottom of FIG. 3, laps over the edge of the concrete slab. The bottom of the lowermost panel 110 rests upon a Z-shaped sheet metal member 103 which has an upwardly extending flange 104 running up the inside of the panel 117, and further includes a downwardly extending flange 105 which laps over the front face of the concrete. The wall panel, 110 below the perimeter beams 80 are attached at their upper inner edges to the flanges 83 of the perimeter beams by J-clips 143'.

Note that each upper wall panel 110 also rests upon a Z-shaped member 103 which laps downwardly at 105 to cover the next lower facing member 127, and extends upwardly at 104 inside the panel 117. These parts can be suitable secured together by sheet metal screws, although the Z-shaped members 103 may be spot-welded to the adjacent frame members 112 of the panels at the time of their construction. The tops of the upper wall panels 110, FIG. 3, are held in place on the perimeter beams by fastening them to the previously described L-brackets 143 which are secured to the flanges 33 of the beams 30 and are also visible in FIG. 10.

Figure 12:
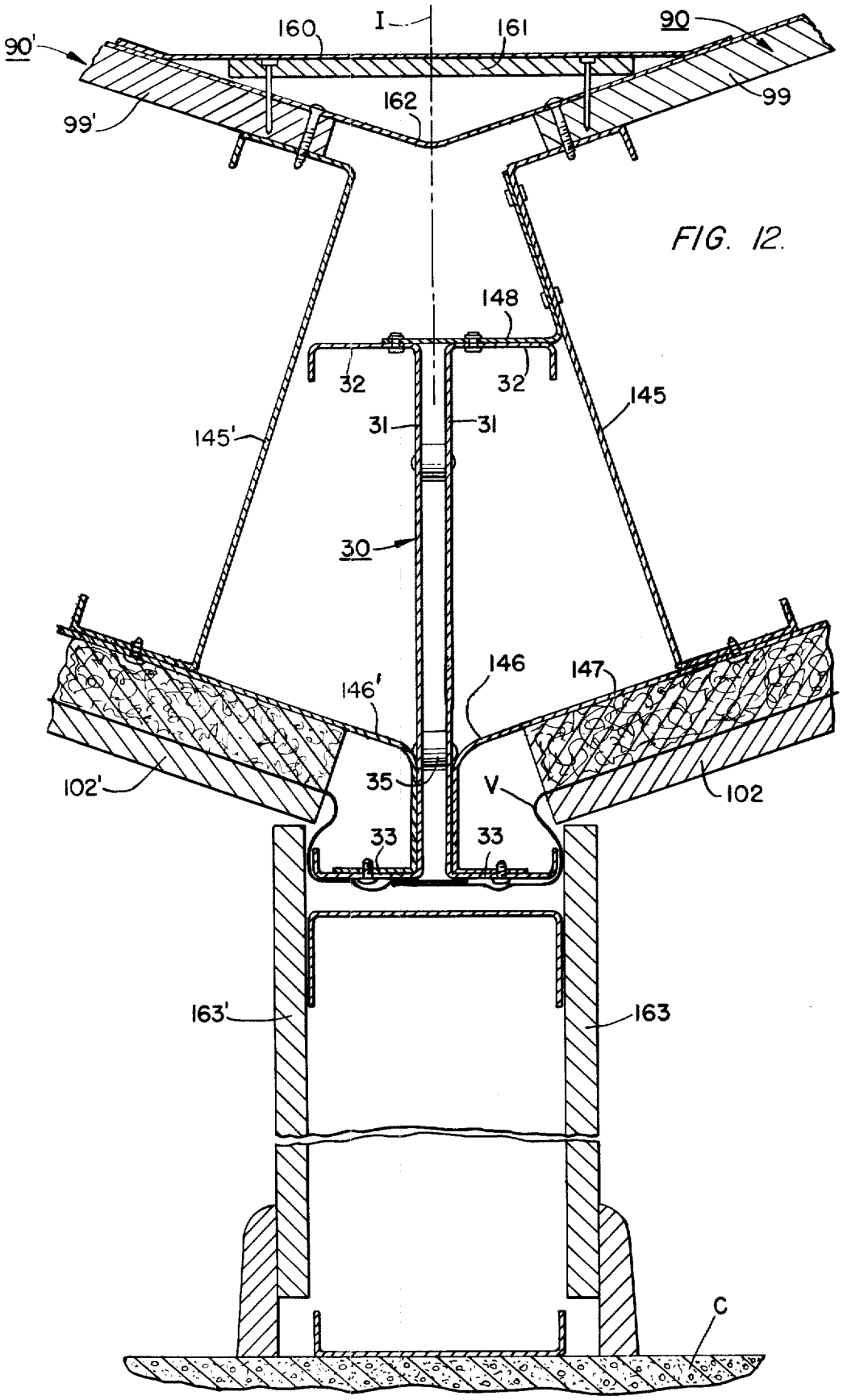
FIG. 12 is an enlarged cross-sectional view showing the intersection of the roof panels of two adjacent building modules sharing a common wall.

FIG. 12 shows an enlarged sectional view through the intersecting grid-line I of two adjacent building modules, for instance at the point shown by the reference character 18 in FIG. 1. On the righthand side of the intersection I, the roof structure and attaching parts are substantially as shown in FIG. 3, and bear similar reference characters. In the lefthand side, similar reference numerals are used, but primed, i.e. 90', 99', 146' and 102'. A metal valley gutter plate 160 spans the intersection of the roof panels 90 and 90' and is backed by a plywood sheet 161. The edges of the gutter plate 160 will be covered by tar paper and shingles when the roofing has been installed. The main wooden roof sheets 99 and 99' are also structurally joined by a metal type plate 162 to anchor them more securely together. Beneath the perimeter beam 30, suitable interior wall finish sheets may be installed as shown at 163 and 163', or the wall may be omitted to provide access between the building modules. A vapor seal sheet V is provided below the perimeter beam 30, the remaining insulation being omitted in this view.

This invention is not to be limited to the exact embodiments shown in the drawings, for changes can be made within the scope of the following claims.

I claim:

1. In a polygonal prefabricated building supported on a supporting surface and symmetrical about a vertical central axis, the building having upright columns equally spaced about said axis, the columns having lower ends supported on the surface and having upper ends joined to adjacent columns by perimeter beams, and the building having roof beams having outer ends joined to the upper ends of the columns and extending diagonally upwardly and inwardly toward said axis and terminating in inner ends located adjacent said axis, and the building having an apex member fixed to the inner ends of the roof beams and securing them together, the structural improvements wherein:

(a) the perimeter beams and the roof beams each comprise paired channel members each having a web portion and two flange portions, the paired channel members which comprise each beam being disposed with their web portions mutually adjacent to each other and separated by a fixed distance space, the web portions being joined by intermediate spacer means, and means securing together the paired webs and the intermediate spacer means to form a unitary beam;

(b) connector means fixed to the upper end of each column and each comprising a rigid beam-receiving tongue extending from the column toward each of the adjacent columns, and a rigid tongue extending from the connector means toward the central axis, the spacer means in each beam terminating short of the end of the beam, and a beam being coupled to each connector means tongue by passing the tongue into said space between its paired webs, and fastening means transfixing the webs and tongues to secure them together; and (c) said connector means each comprising multiple metal bars fixed tangentially to a column and containing the column between them and having ends extending toward an adjacent column, and said tongues which are attached to the perimeter beams each comprising the ends to two adjacent bars pinched together and entering the space between the webs in the end of a perimeter beam; and each connector tongue which is attached to a roof beam comprising an additional tongue member secured to the metal bar which is located on the side of the column facing toward the center axis.

2. In a prefabricated building as claimed in claim 1, said apex member comprising an annular member having a tongue rigidly connected to it opposite each of the columns and each extending outwardly from said central axis toward the associated column and passing into the space between the webs in the end of a roof beam, and fastening means transfixing the webs and tongues to secure them together.

3. In a prefabricated building as claimed in claim 1, said supporting surface comprising a concrete slab having mounting bolts fixed in and extending upwardly from its surface in the vicinity of each column, and each column comprising a length of pipe having a plate fixed to its bottom end and sitting on the slab and secured by said bolts, the plates being narrow and extending on both sides of the column toward an adjacent column.

4. In a prefabricated building as claimed in claim 1, the building having in the space below each perimeter beam and extending downwardly to said surface and laterally between adjacent columns an opening corresponding with one polygonal wall, and the building having multiple wall panels fitting into said wall spaces, each panel comprising a prefabricated box frame filled with insulating material and having an outer panel sheet, the outer panel sheets of adjacent panels being shaped to lap each other to hide the intersections between panels; and means for securing the panels in place in the wall opening comprising L-bracket clip means along the top of the wall panel and having a horizontal portion attached to the flanges of the perimeter beam and having a vertical portion extending downwardly from the folded edge and overlying the upper member of the box frame of the wall panel and secured thereto, and the wall panels having a thickness sufficient to receive and conceal a column; and the building having a Z-shaped plate with a first portion lying upwardly against the lower inner surface of a wall panel, an intermediate portion lying under a wall panel on said supporting surface, and a third portion extending downwardly to cover the outer perimeter of the supporting surface.

5. In a prefabricated building as claimed in claim 1, each roof beam having the two upper flange portions of its channel members bent to lie in the planes of the openings in the roof defined by adjacent roof beams, and said openings each being closed by multiple adjacent roof panels of trapezoidal shape, each roof panel having opposed peripheral edges which are mutually parallel and parallel to a perimeter beam, and the panels further having opposed end edges shaped to overlap the upper flange portions of adjacent roof beams.

6. In a prefabricated building as claimed in claim 5, each roof panel comprising a prefabricated box frame having opposed channel members extending along its two peripheral edges and having Z-shaped frame members extending along each end edge, the panels further including interior and exterior sheets overlying and closing the frame, and insulation between said sheets, one edge of each Z-shaped frame member lying between a flange of a roof beam and an exterior sheet overlying it.

7. In a prefabricated building as claimed in claim 6, the peripheral edge frame member of the roof panel nearest each peripheral beam being coupled to the beam by bracket means, and the edge of the roof panel sheet closest to each peripheral beam ending above the space between beam channel members.

8. In a prefabricated building as claimed in claim 7, a roof overhang member on each side of the building extending outwardly from the exterior wall, each overhang member including a frame, a roof sheet supported on the frame at the angle of the adjacent roof panel sheet, a trim strip extending downwardly from the outer edge of the roof sheet, a metal plate above the perimeter beam and overlying the roof sheet and the roof panel sheet and fixed to both sheets, and bracket means connecting the frame of the overhang member with the perimeter beam beneath the roof sheet.

9. In a prefabricated building as claimed in claim 1, at least one intermediate floor located between said roof and said supporting surface, each floor comprising intermediate connector means fixed partway up each column and having a tongue extending toward each other column and supporting intermediate perimeter beams extending between the columns at the floor level, and the connector means having floor-supporting tongues extending toward said central axis; a floor beam coupled to each floor-supporting tongue and extending toward the central axis; and means at said axis joining the floor beams and supporting them against said supporting surface.

10. In a prefabricated building as claimed in claim 9, multiple floor panels each comprising a prefabricated box frame having opposed parallel longer sides formed of channel members and having opposed parallel shorter sides formed of Z-shaped members, floor sheets enclosing said box frame and on said two shorter sides extending beyond the frame and overlying edges of the opposed Z-shaped members, the panels on one longer side extending beyond the channel member and on the other longer side only partially covering the adjacent channel member, whereby the longer side of one panel laps the frame of the adjacent panel, said floor beams each being included in one panel and comprising an extra channel member occupying the space beneath said longer side which extends beyond the frame.

11. In a prefabricated building as claimed in claim 10, the building being hexagonal as view in plan view and having six columns and having three floor beams symmetrically disposed inwardly toward said central axis from alternate columns; the shorter sides of each floor panel sheet and the edges of the Z-shaped members which lie below them respectively overlap one floor beam and one intermediate perimeter beam, and each space encompassed by two floor beams and two perimeter beams defining a parallelogram which is filled by floor panels all laid parallel to each other with their longer edges lapped.

12. In a prefabricated building comprising two hexagonal buildings as claimed in claim 1, the buildings occupying a hexagonal grid composed of isoceles triangles and being located mutually adjacent to each other and sharing a common hexagonal interface between them including a common perimeter beam and two common columns, the connector means on each common column comprising three metal bars fixed to the common column and having their ends pinched together to form three tongues oriented in plan view at 120 degree mutual angles and each tongue extending toward an adjacent column of one of said buildings, and the common perimeter beam of the buildings having its two channel members symmetrically disposed on opposite sides of the hexagonal grid line comprising the interface between the buildings; and the tongues which are attached to the roof beams of the respective buildings each comprising a separate metal bar secured to the metal bar which is located on the side of the column which faces toward the central axis of each of the buildings.

13. In a prefabricated building as claimed in claim 12, each roof beam having the two upper flange portions of its channel members bent to lie in the planes of the openings in the roof defined by adjacent roof beams, and the openings each being closed by multiple adjacent roof panels of trapezoidal shape, each roof panel having opposed peripheral edges which are mutually parallel and parallel to a perimeter beam, and the panels further having opposed end edges shaped to overlap the flange portions of adjacent roof beams.

14. In a prefabricated building as claimed in claim 13, each roof panel comprising a prefabricated box frame having opposed channel members extending along its two peripheral edges and having Z-shaped frame members extending along each end edge, the panels further including interior and exterior sheets overlying and closing the frame, and insulation between said sheets, one edge of each Z-shaped frame member lying between a flange of a roof beam and an exterior sheet overlying it.

15. In a prefabricated building as claimed in claim 14, the peripheral edge frame member of the roof panel nearest each peripheral beam being coupled to the beam by bracket means, and the edges of both roof panel sheets closest to each peripheral beam ending above the space between beam channel member; a metal strip spanning the trough formed by two adjacent roof panel sheets and secured to both sheets; and gutter means fixed to the roof panel sheets and overlying the metal strip.

* * * * *